United States Patent [19]

Clark

[11] 4,353,478

[45] Oct. 12, 1982

[54] VAPOR SEAL FOR FLOATING ROOF TANK

[76] Inventor: William F. Clark, Rte. #1, Box 208-A, Glasgow, Va. 24555

[21] Appl. No.: 242,227

[22] Filed: Mar. 10, 1981

Related U.S. Application Data

[63] Continuation of Ser. No. 68,457, Aug. 21, 1979, abandoned.

[51] Int. Cl.[3] ..... B65D 88/46; B65D 88/50

[52] U.S. Cl. ..... 220/224; 220/226

[58] Field of Search ..... 220/224, 226, 222; 16/189

[56] References Cited

U.S. PATENT DOCUMENTS

| | | | |
|---|---|---|---|
| Re. 22,169 | 9/1942 | Hammeren | 220/224 |
| 887,548 | 5/1908 | Trumble | 16/189 |
| 1,865,969 | 7/1932 | Schurmann | 220/224 |
| 2,302,904 | 11/1942 | Wiggins | 220/224 |
| 2,914,212 | 11/1959 | Fino | 220/227 |
| 3,079,029 | 2/1963 | Moyer et al. | 220/226 |
| 3,167,206 | 1/1965 | Nelson | 220/224 |
| 3,269,583 | 8/1966 | Fino | 220/226 |
| 3,390,803 | 7/1968 | Smith | 220/224 |
| 3,565,279 | 2/1971 | Joor | 220/226 X |
| 3,795,339 | 3/1974 | Barbier | 220/222 |
| 4,004,708 | 1/1977 | Boyd | 220/226 |
| 4,130,217 | 12/1978 | Hills et al. | 277/138 X |

FOREIGN PATENT DOCUMENTS

| | | | |
|---|---|---|---|
| 1094690 | 12/1967 | United Kingdom | 220/226 |

*Primary Examiner*—Allan N. Shoap
*Attorney, Agent, or Firm*—William J. Daniel

[57] ABSTRACT

In a storage tank for liquids, such as petroleum liquids and the like of the type having a generally upstanding cylindrical tank wall and disposed within the wall a generally circular roof therefor adapted to float upon the contents of the tank in vertically movable relation according to a variation in the volume of such contents so as to define a clearance space being defined between the inner wall surface and the outer peripheral rim of said floating roof, an improved vapor seal for said clearance space comprising an elongated resilient pad extending circularly around the inner face of the tank wall with its long axis in generally upstanding relation to the tank top and its outer face at least partially in contact with the wall, such pad having an exterior surface constituted of durable material resistant to attack by the liquid being stored and being supported by a plurality of supports arranged at spaced points around said roof rim, each such support having a base section affixed to the roof rim, a substantially rigid arm hingedly connected at its lower end to the base section and extending generally upwardly therefrom, an extension at the upper end of the arm in engagement with the inner face of the pad, and means for biasing the arm outwardly from said base to urge the outer face of the pad against the tank inner wall; and a circular skirt of flexible impervious material substantially sealed along its top and bottom edges respectively to the lower end of the pad and the tank rim and spanning therebetween.

10 Claims, 4 Drawing Figures

VAPOR SEAL FOR FLOATING ROOF TANK

This is a continuation of Ser. No. 68,457, filed Aug. 21, 1979, now abandoned.

FIELD OF THE INVENTION

This invention relates to the field of storage tanks for liquids, especially petroleum liquids such as gasoline, fuel oil and the like, of the type having a floating roof or top moving vertically within a cylindrical side wall and is concerned with the provision of an effective vapor seal for the clearance space therebetween.

INTRODUCTION TO THE INVENTION

It is now common practice to store various liquids typified by gasoline, fuel oil and similar petroleum liquids in generally cylindrical storage tanks of very large diameter in the order of hundreds of feet. Such tanks have a generally upstanding cylindrical wall constructed of metal plates or the like bolted, riveted or otherwise secured together and are provided with an inner circular roof or top which is intended to float upon the top surface of the tank contents, riding upon pontoon or like flotation means, so as to move telescopingly up and down within the tank as the volume of the contents increases or decreases during filling and consumption. Some clearance space must necessarily exist between the outer rim of the roof and the inner face of the tank wall and due at least in part to the practical impossibility of constructing both tank and roof with exact circularity, such clearance space for tanks of the size in question can and does have a considerable magnitude, say in the order of six or more inches in annular radius. During its vertical movement, the tank roof is capable of lateral shifting over this clearance space which means that the effective localized clearance space at a given site around the tank periphery can vary from less than one inch to twelve inches or more.

It has been conventional in this art for many years to provide a so-called primary sealing means disposed between the tank rim and the wall periphery designed both to maintain the roof in centrally disposed position insofar as possible and to provide a closure for this clearance space. A wide variety of primary sealing devices have been developed, most of which are in the form of resiliently biased shoes or the like and most have proved more or less effective in affording a crude seal for the clearance space, preventing the in-flow of water from rain or snow and the like and reducing evaporative losses from the tank contents.

It is known in the art to augment the sealing function of the primary seal by means of a so-called secondary seal and in recent years, the increasing stringency of anti-pollution laws and regulations has cast urgency on the critical need in this field for a secondary sealing means which is effective to provide a more efficient degree of sealing for the clearance space around the roof while resisting the very substantial forces that act against any sealing means existing in this region. The seal is inherently subjected to heavy shearing forces during the vertical movement of the roof which are aggravated by irregularities in the wall surface and rim edge, including projecting bolt and rivet heads and the edges of overlapping plates, which tend to engage the sealing means and cause the same to become wedged and trapped against free vertical movement and also apply substantial abrasion thereto. Furthermore, the sealing means must withstand massive lateral loading due not only to the massive weight of the roof of the tank but the aerodynaamic action upon that roof by strong winds and the like.

Consequently, the development of an efficient secondary seal has received much attention by the skilled workers in this art and many different suggestions appear in the patented art, including among others the following:

U.S. Pat. Nos. 2,471,404, 2,973,113, 3,167,206, 3,119,511, 3,319,329, 3,325,041, 3,338,454, 3,565,279, 3,915,332, 4,014,454, 4,036,395, 4,099,643, 4,130,217, 4,138,032 and 4,147,274.

For various reasons, none of these proposed solutions has yet been found in actual practice to provide an acceptable answer to all of the harsh requirements which must be satisfied by the tank seal, and there remains, therefore, a compelling need in this field for an effective tank sealing means.

OBJECTS OF THE INVENTION

The objects of the present invention include the provision of an improved vapor sealing means for a floating roof tank which is adapted to accommodate more effectively to the inherent lateral variation of the space to be sealed while at the same time resisting the destructive action of the vertical movement of the tank roof.

Another object of the invention is an improved vapor seal in the form of an elongated resilient pad having a surface of durable wear resistant and solvent resistant material which is disposed circularly above and around the roof rim for contact along one of its long sides against the inner tank wall around the periphery of the latter, the pad being supported at spaced peripheral points by rigid arms hingedly connected at their lower ends to the tank rim and biased outwardly therefrom to urge the pads against the tank wall, the annular space between the pad and rim being spanned by means of a flexible imprevious circular curtain or skirt.

These and other objects of the invention will be more fully explained by the following description when read in conjunction with the accompanying drawings.

DETAILED DESCRIPTION OF THE INVENTION

Figure 1:
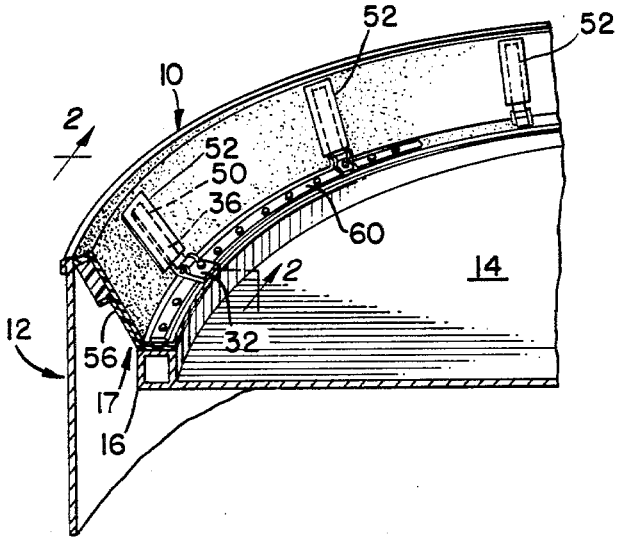
FIG. 1 is a fragmentary perspective view of a small section of a floating roof storage tank equipped with the improved vapor seal of the invention illustrated in diagrammatic fashion to convey the gist of the invention without regard to the relative scale of the parts involved.
Figure 4:
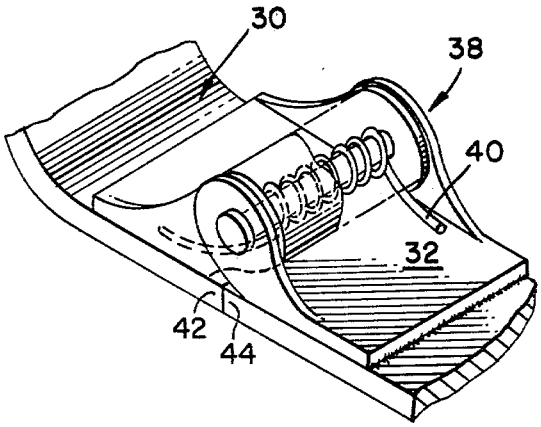
FIG. 4 is a detailed view taken in cross section through a preferred hinge construction useful in the invention.

In the drawings, the numeral 10 generally designates an open topped storage tank having a generally upstanding side wall 12 and a floating roof 14 therewithin. Usually, the roof 14 is constructed in the form of a flat steel deck to the underside of which is affixed pontoons or similar flotation means (not shown) so that the roof floats buoyantly upon the liquid contents (also not shown) in the tank. Around the peripheral edge of roof 14 is a rim which for convenience sake is illustrated as taking the form of a box-shaped channel 16 althrough an upstanding C-shaped channel or inverted L-shaped angle would serve equally well for present purposes. The region indicated at 17 between the inner face of wall 12 and the outer edge of rim 16 is the clearance space which must be effectively sealed to avoid the loss of vapor therethrough.

The details of the actual tank construction form no part of the present invention and can be of any conventional sytle; consequently, the tank wall and the roof are only schematically illustrated in the accompanying drawings.

According to the invention, an elongated resilient pad 20 which is circular or "endless" in configuration extends around the entire periphery of the inner side of wall 12, being disposed vertically above the tank roof 16 with its greater dimension or long axis, i.e., height, in generally upstanding relation thereto (with some variation in angularity as the position of the tank roof shifts during use). The resilient pad 20 makes sliding contact along its outer long or tall face 22 with the inner tank wall and must, therefore, have at least its surface constituted of tough, durable, abrasion resistant material which is also resistant to deterioration by the solvent action of whatever liquid may be contained by the tank. To this end, the resilient pad preferably takes the form of a core 24 of a compressible foam, such as sponge rubber, polyurethane or like polymeric foam, preferably of the closed cell type, which is enveloped or wrapped within a casing or sheath 26 of a flexible fabric or the like having the necessary properties of toughness, durability and abrasion and solvent resistance. The casing also protects the porous foam core against the deteriorative attack of the tank contents, most presently available foam materials being ordinarily susceptible to such attack.

It has been found that if pad 20 is of substantially equal dimension in both its axes, it does not adequately withstand the shearing forces applied to it during vertical movement of the tank roof, exhibiting a pronounced tendency to undergo rolling or collapsing particularly during movement in the downward direction and to avoid this tendency, the dimension of the pad in the upstanding direction needs to significantly exceed its width or horizontal dimension, say by a factor of at least two and preferably three, and the term "elongated" is employed to convey this dimensional relationship. A closed cell polyurethane core two inches by six inches in size has been found to perform acceptably in practice, the circular length of the pad being dependent on the diameter of the tank, since the pad is formed as an "endless" circle with its ends held in mutually abutting relation.

Figure 2:
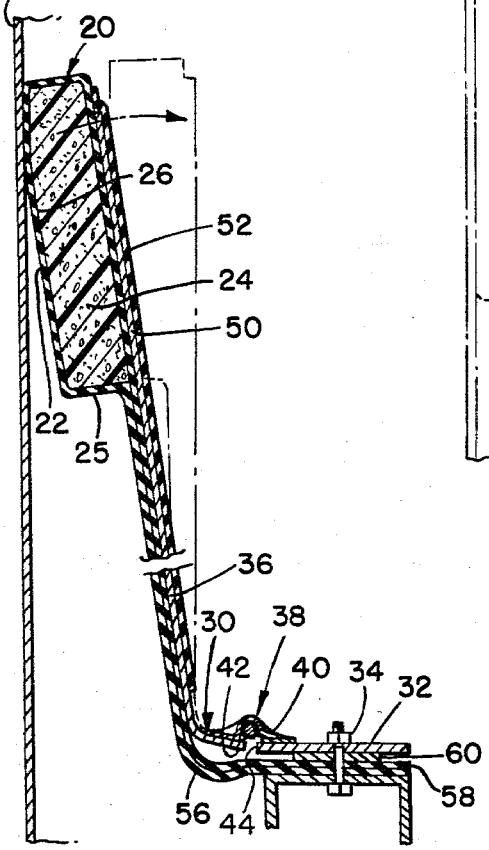
FIG. 2 is an enlarged view taken in cross section substantially along line 2—2 of FIG. 1 and showing the details of one embodiment of vapor seal according to the invention and including a dotted view to suggest some of the range of variation of which this embodiment is capable.

The circular pad 20 is supported from the rim 16 of roof 14 by a plurality of articulated supporting means 30 arranged in bracket fashion at spaced locations around the roof periphery. The extent of the spacing can vary in practice, ranging from perhaps 12 inches to 36 inches with 18 inches to 24 inches being typical, and will depend upon the specifications of a particular customer. Each articulated support means preferably takes the form of a base leg 32, which is bolted or otherwise fixedly secured as at 34 to the upper side of the channel 16 forming the rim of the tank. Extending upwardly from base leg 32 is a rigid supporting arm 36 connected at its lower end to the outer end of base leg 32 by means of an articulation 38 such as a hinge permitting arm 36 to pivot from a generally vertical position indicated in dotted lines in FIG. 2 to a radially displaced position suggested by the solid line position in that figure (but exhibiting in many cases considerably greater angularity as will be pointed out in the description of the embodiment of FIG. 3). The supporting arms 36 can be constructed of strap iron or steel since they must possess considerable rigidity, but heavy duty rigid plastic materials can undoubtedly be substituted.

In order to bias supporting arms 36 radially outwardly and thereby urge the circular pad 20 into contacting engagement with the tank wall 12, biasing means are provided for applying an outward pivoting force to each of arms 36, preferably in the form of a spring 40, such as a coil spring built into the hinge assembly, but a leaf spring or other spring means could be substituted as could the action of gravity, provided the mass of the unit was made sufficiently great to achieve the desired loading force.

It is advantageous to incorporate means for limiting the radially outward pivotal displacement of the supporting arms 36, and thus the circular pad 20 itself, since otherwise the tendency of these arms to drop the plane of the roof is increased. To this end, as indicated in the drawings, the lower end of each supporting arm 36, which carries one side of hinge 38, can be arcuately bent to make an abutting contact along its inner edge 42 with an outer edge 44 of the base leg 32 and thereby define a stop means to limit the permissible lower angularity of the arm to a suitable value, for instance, preferably around 35°–40° relative to the plane of the roof. Alternatively, if the curved end of each supporting arm is extended and the placement of the hinge axis is inwardly of the tank rim, the curved "foot" of the arm can itself act as a detent limiting pivotal movement.

The upper end of each arm 36 is formed as an extension as at 50 for connection to the inner long, i.e., tall, face of the resilient pad 20. For this purpose, a pocket 52 can be added to the durable fabric covering of the pad into which the extension end 50 snugly fits. Alternatively, the casing fabric could be bolted at plural spaced points or adhesively affixed to the inner side of the extension 50. In order to maintain firm working control over the resilient pad to prevent its rolling and shifting during roof movement, the supporting arm extension 50 should make engagement with, i.e., be anchored to, the back side of the pad over at least a major portion of the long (i.e., generally vertical) dimension, i.e., more than half that dimension, and preferably about 70–80% of that dimension. If the arm extension relative to the long axis of the pad 20 is too short, the pad is capable of excessively free bending movement which increases its likelihood to roll against the tank wall. On the other hand, if the upper end of extension 50 projects too near to the upper end of the pad, some risk may be created of that end tearing through the pocket and coming into engagement with the tank wall itself which, in case the arm is constructed of iron, could cause sparks with the danger of igniting the ordinary flammable vapors from the tank contents. Of course, if the arm were made of plastic or other non-sparking material, then this risk would be eliminated and greater latitude might be available as to the location of the termination of the arm extension relative to the upper end of the resilient pad.

From the lower end 25 of resilient pad 20 stretches a skirt or curtain 56 of a flexible material impervious to vapor penetration and resistant to the solvent action of the contents of the tank and the lower margin of this skirt is attached in sealed relation to the rim of the tank roof as at 58 by means of a strap 60 bolted at spaced points, e.g. six inch centers, to the rim. In a preferred form of the embodiment of FIG. 2, the skirt 56 and the casing 26 for the resilient pad 20 are formed of a single piece of fabric which is doubled upon itself along its median with the pad being confined within its closed end, and the doubled over sides of the fabric are preferably sealed or adhered together, e.g. with a contact adhesive, below the pad so as to form a composite dual thickness fabric that can be attached at its lower margin to the tank rim. It has also been found advisable to adhere the compressible foam core to the envelope, as by means of a contact adhesive or the like, along at least one of the long sides of that core, preferably the radially outward face 22 thereof, and ideally over all sides of the core 24. In this way, the core is better integrated with the casing and is more definitely fixed thereto which contributes to maintaining control over the core position during roof movement.

In use, the secondary sealing arrangement of the present invention freely adjusts its vertical angularity so as to match the lateral position of the floating tank roof. Thus, as suggested in FIG. 2, when a part of the tank roof is positioned in close proximity to the tank wall, the rigid supporting arm 36 as well as the resilient pad 20 carried thereby assume an essentially vertical position, and in this position, the radially outer face 22 of pad 20 is in contact with the tank wall over virtually its entire area, affording a particularly effective seal against the loss of vapors through the clearance space 17. On the other hand, when the tank roof shifts its position and thereby moves a certain region of its periphery away from the tank wall, the appropriate rigid supporting arm or arms 36 under the biasing force applied thereto by the biasing means 38 swings radially outwardly to accommodate to the increased distance within the limits permitted by the stop means which are selected so as to cover the full spread of lateral positions possible for the tank roof in a given structure. As the tank roof in a given region moves away from the adjacent wall section and the resilient pad takes on a greater angularity (from the vertical), the extent of the area of the outer face 22 of pad 20 making contact with the tank wall naturally decreases but due to the inherent resilience of the pad, there is created in any case a sufficient area of contact throughout the entire positional range of the pad to achieve an adequate vapor seal.

Figure 3:
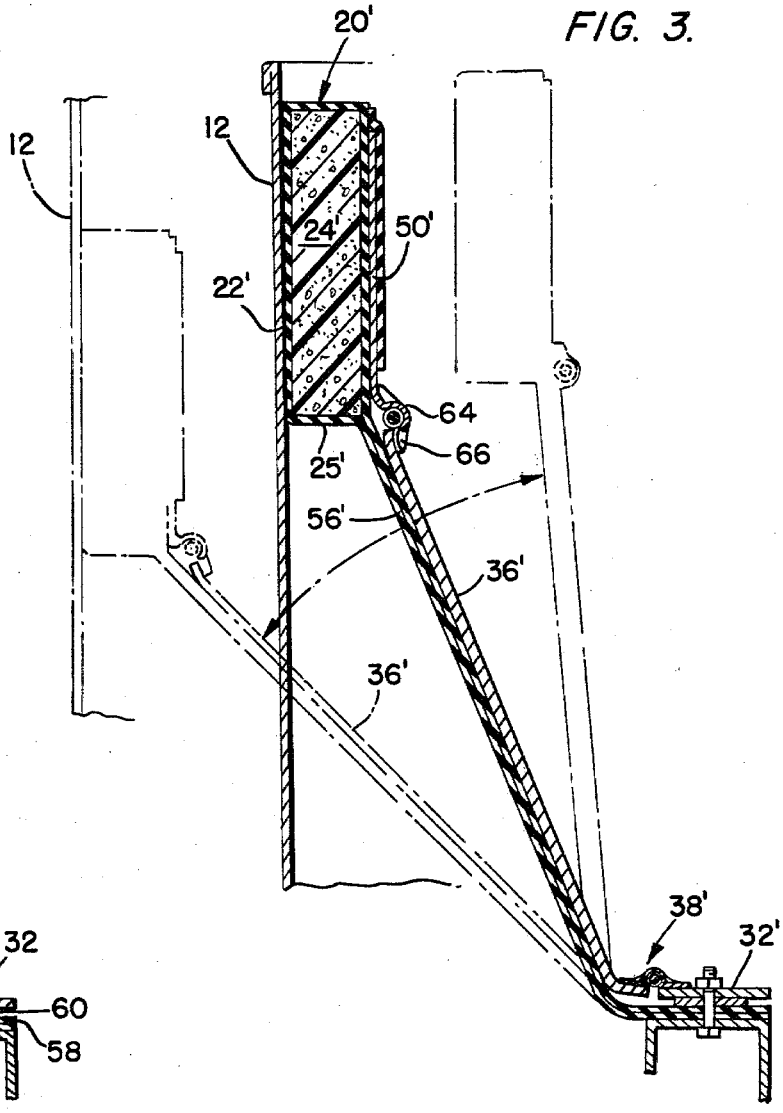
FIG. 3 is a view similar to FIG. 2 of an alternative preferred embodiment utilizing a doubly articulated support, two dotted line positions being depicted to illustrate the extreme positional variations of this seal embodiment together with an intermediate solid line view.

An alternative preferred embodiment of the sealing arrangement of the invention is shown in FIG. 3 which embodiment has the advantage over the initial embodiment of providing full area contact between its radially outward face 22 and the tank wall over the entire long dimension of the resilient pad independently of the angular position of the supporting arm. To this end, the pad engaging extension 50' of the rigid supporting arm 36, instead of being formed as in the initial embodiment as an integral extension of that arm, is made as a separate piece and articulated as by means of a hinge 64 similar to the hinge 38 connecting the lower end of the supporting arm 36 to the base leg 32. This additional hinge 64 preferably includes biasing means 66 so as to urge the extension and the resilient pad carried thereby to a radially outward position relative to the rigid supporting arm. This additional hinge could, of course, include stop means preventing the arm and associated pad from undergoing excessive radially outward pivotal movement which might tend to increase the likelihood of the pad becoming wedged against the wall of the tank and rolled or twisted forcibly and damaged. For example, although not shown in FIG. 3, the hinge could include the same cooperating abutting surfaces as in hinge 38 to prevent extension 50' and pad 20' from swinging outwardly beyond the plane of the rigid supporting arm 36', a coplanar relationship being the minimum position for these parts when the seal is disposed in substantially vertical position. Obviously, this exact limiting position is not critical and the extension and pad could be allowed to pivot somewhat past the plane of the arm provided that the limiting position was such as to avoid the wedging problem noted above. At the other extreme, since the biasing means 66 is effective to prevent the extension 50' and pad 20' from swinging inwardly, stop means are not needed but could be added if desired.

As shown by the dotted line positions in FIG. 3, the alternative preferred arrangement is capable of a complete range of angular positions without loss of the full face-to-face contact between the resilient pad 20' and the tank wall. Indeed, this range could extend from about 0° to 90° (from the vertical), although in practice, a 90° orientation is hardly advisable due to the severely increased chances of the pad becoming hung up against the tank wall and rolled or twisted during vertical movement of the floating roof with consequential damage to the arrangement. If the supporting arm were in virtually flat or horizontal position, it would be subjected to maximum bending moments; whereas when the supporting arm has a definite angular position, its bending moment is reduced and much of the loading applied thereagainst acts in compression and consequently is better resisted before structural damage will occur. Therefore, in practice, it is definitely preferred that the dimensions of the elements of the arrangement, especially of the supporting arm relative to the horizontal extent of the clearance space 17 for a given structure be so selected that in operation the supporting arm cannot swing substantially beyond say about 45° (from the vertical) when the clearance space is at a maximum.

In assembling the vapor seal of the present invention, a suitable length of the fabric forming the skirt but with a double width is laid out on the floor and a corresponding length of the resilient pad is laid thereon with one short face of the foam core aligned with the center axis of the fabric length. The exposed face, and preferably all faces, of the foam core is coated with a contact adhesive as is the exposed face of the skirt fabric on which the core lies, and the fabric is then folded upon itself along the median axis and adhered to the adhesively coated surface of the core and the short side of the skirt fabric itself. In this way, an integrated composite skirt is produced with the foam core adhesively embedded therein adjacent one of its ends. In practice, lengths of the resultant fabric are installed in place on the top of the tank roof in sequence as needed to encircle the roof perimeter, the margins of adjacent fabric pieces being adhesively connected together. It is helpful for the length of foam core to be displaced lengthwise of the associated skirt fabric so that one end of the core projects say six inches or more beyond one end of the fabric while the opposite end of the core is recessed relative to that end of the fabric. This permits successive lengths of the fabric/core composite to be easily assembled together, the projecting end of the core feeding in telescoping relation into the recessed end of the next fabric length. Durable resistant fabrics of the type employed in the present invention are in themselves old in the art and do not require specific description. In brief, they are formed by coating both sides of a heavy duty industrial fabric with heavy applications of a rubberized coating composition and allowing the composition to dry. While the fabric skirt can be allowed to suspend free from the lower edge 25, 25' of the resilient pad 20, 20, it is preferred to extend the fabric pocket 52 widthwise of the skirt as needed to receive substantially the entirety of the length of the supporting arms 36, 36' as indicated in FIG. 1. In case of the doubly articulated embodiment of FIG. 2, the pocket may be interrupted at the location of the top hinge 64 although it could equally well extend over this hinge if the pocket were sufficiently loose as to permit the hinge to be inserted therethrough.

In actual practice, the vapor sealing arrangement of the invention would ordinarily be associated with some kind of primary sealing means selected from among the variety thereof conventionally known in the art, some of which are disclosed, for example in U.S. Pat. No. 4,130,217. Since the primary sealing means is in any case old and has no necessary association with the present invention either in function or structural construction, the primary sealing means has been omitted from the present description.

While certain alternatives and variations have been described during the course of the aforegoing description, others will certainly be within the skill of an expert in this field, and the invention is, therefore, not intended to be limited to the details of the disclosed embodiment, except as necessitated by limiting language in the appended claims.

What is claimed is:

1. In a storage tank for liquids such as petroleum liquids and the like, comprising a generally upstanding cylindrical tank wall and disposed within said wall a generally circular roof therefor adapted to float horizontally upon the contents of the tank in vertically movable relation according to a variation in the volume of such contents, a clearance space being defined between the inner wall surface of said tank and the outer peripheral rim of said floating roof, in combination, an improved vapor seal for said clearance space comprising a resilient pad extending annularly around the inner wall surface of the tank in vertically spaced relation above the roof rim, said pad being elongated in vertical cross section with a height substantially greater than its thickness and having two oppositely facing tall faces extending between upper and lower ends, said pad being arranged with its height direction extending generally vertically so that one of said tall faces faces generally radially outwardly and the opposite tall face faces generally radially inwardly; a casing constituted of durable material resistant to attack by the liquid being stored tightly enveloping said pad in generally tubular fashion and having sections thereof generally coextensive with the tall pad faces, at least one of which sections is adhered to the corresponding pad face; a plurality of supports for the annular pad arranged around said roof rim in peripherally spaced apart relation, each of said supports comprising a base affixed to the roof rim, a substantially rigid arm hingedly connected at its lower end to said base and extending generally upwardly therefrom, a separate extension at the upper end of said arm, a hinged connection between the upper end of said rigid arm and the lower end of said extension, and means for biasing said extension generally radially outwardly of said arm about said hinged connection; means anchoring said extension to the casing section corresponding to the inwardly facing tall pad face over more than half the tall dimension thereof; means for biasing said arm outwardly from said base to urge the outer face of the pad toward said tank inner wall; and a skirt of flexible impervious material extending from the casing to the tank rim to close the space therebetween.

2. The storage tank of claim 1 including means for limiting the outward pivotal movement of each said rigid arm to prevent the same from pivoting below the plane of the tank roof.

3. The storage tank of claim 2 including stop means for limiting the outward pivotal movement of the corresponding rigid arm.

4. The storage tank of claim 3 wherein the lower end of said rigid arm is adapted for abutting contact with said base to constitute said stop means.

5. The storage tank of claim 1 wherein said hinged connection between the said ends of said extension and said arm is adjacent the lower end of said pad.

6. The storage tank of claim 1 wherein said casing is formed integrally with the flexible skirt.

7. The storage tank of claim 1 wherein said skirt has one side facing generally radially inwardly and said improved vapor seal further comprises means on the inwardly facing skirt side for retaining that skirt side in close proximity to the arms.

8. A storage tank as in claim 1 wherein the vertical cross-section of said pad is generally in the shape of a rectangle with the long axis of the rectangle being at least twice the length of the short axis thereof.

9. The storage tank of claim 1 wherein the flexible skirt has a lower margin overlapping with the roof rim and said improved vapor seal further comprises clamping means extending around the roof rim at least over the peripheral spaces separating the bases of said supports for clampingly securing the lower margin of the flexible skirt to said rim.

10. The storage tank of claim 1 wherein the upper end of said extension terminates short of the upper end of the casing section corresponding to the inwardly facing tall pad face to minimize the possibility of contact by the upper extension end and the inner tank surface.

* * * * *